US005118099A

United States Patent [19]

Vatterot

[11] Patent Number: 5,118,099

[45] Date of Patent: Jun. 2, 1992

[54] ARTICULATED PLAYGROUND BRIDGE

[75] Inventor: Ralph O. Vatterot, Farmington, Mo.

[73] Assignee: Iron Mountain Forge, Farmington, Mo.

[21] Appl. No.: 553,107

[22] Filed: Jul. 13, 1990

[51] Int. Cl.[5] ..... A63B 9/00

[52] U.S. Cl. ..... 482/35; 14/18; 482/51

[58] Field of Search ..... 272/112, 113, 70; 14/69.5, 2.4, 1, 18, 20, 37; 119/82; 52/108; 108/67

[56] References Cited

U.S. PATENT DOCUMENTS

| | | | |
|---|---|---|---|
| 3,770,106 | 11/1973 | Koehl et al. | 52/108 |
| 3,943,585 | 3/1976 | Pedersen | 14/69.5 |
| 4,024,595 | 5/1977 | Brown | 14/1 |
| 4,457,035 | 7/1984 | Habegger et al. | 14/18 |
| 4,601,079 | 7/1986 | Corica | 14/2.4 |
| 4,681,482 | 7/1987 | Arciszewski | 14/1 X |

OTHER PUBLICATIONS

Author: Gametime, Inc.; Fort Wayne, AL; Title: Gametime 1988 pp. 16,21; Year: 1987.

*Primary Examiner*—Richard J. Apley
*Assistant Examiner*—D. F. Crosby
*Attorney, Agent, or Firm*—Senniger, Powers, Leavitt & Roedel

[57] ABSTRACT

The disclosure pertains to an articulated playground bridge including a frame, and a deck having opposite sides and opposite ends. The deck is attached at its opposite ends to the frame such that the deck is suspended above the ground by the frame with the deck sagging downwardly between its opposite ends. The deck is made up of a plurality of generally rectangular planks having longitudinally edges extending in side-to-side direction with respect to the deck. Adjacent planks are in generally edge-to-edge relationship, and pivotally interconnected by a hinge pin extending generally along the longitudinal edges of the adjacent planks. Thus, the planks will pivot upwardly and downwardly in an undulating fashion with respect to each other when the bridge is crossed.

11 Claims, 2 Drawing Sheets

ARTICULATED PLAYGROUND BRIDGE

BACKGROUND OF THE INVENTION

This invention relates generally to playground equipment and more particularly to an articulated playground bridge.

Children enjoy playing on playground bridges which swing or undulate as they are crossed. Generally, bridges of this type have articulated decks which are suspended from their ends. The decks are made up of rectangular planks which are connected at their longitudinally opposite ends to ropes or chains extending alongside the deck so that the deck will swing and/or undulate as the bridge is crossed. This construction requires that the planks and ropes or chains be relatively strong to withstand the stresses applied to the deck by a child running across or jumping on it. As a result, the planks and ropes or chains must be relatively heavy-duty and are thus more costly. Further, assembly of the deck at the playground site from a set of planks and ropes or chains is difficult and time consuming.

Presently, articulated bridges of the type described have straight horizontal handrails extending above the deck along opposite sides of the deck. However, this design makes it difficult for a child crossing the bridge to comfortably maintain a grip on the hand rail. The deck of such a bridge must necessarily sag downwardly between its suspended ends in order to provide sufficient extra length in the deck for undulation of the deck. Therefore, the vertical separation of the handrail from the deck increases toward the center of the deck. A handrail located waist high to the child at one end of the bridge, may be located shoulder high or above at the center of the deck making it difficult or uncomfortable for the child to maintain his or her grip on the handrail while crossing the bridge.

SUMMARY OF THE INVENTION

Among the several objects of the present invention may be noted the provision of an improved articulated bridge which undulates as it is crossed; the provision of such a bridge which is easily assembled at the playground site; the bridge which is both lightweight and strong; the provision of such a bridge which resists accumulation of water and dirt thereon; the provision of such a bridge with handrails which may easily be reached at all points along the bridge; and the provision of such a bridge which may be inexpensively manufactured.

Generally, an articulated playground bridge of the present invention comprises a frame, and a deck having opposite sides and opposite ends. Means attaches the deck at its opposite ends to the frame such that the deck is suspended above the ground by the frame with the deck sagging downwardly between its opposite ends. The deck comprises a plurality of generally rectangular planks having longitudinal edges extending in side-to-side direction with respect to the deck with adjacent planks being in generally edge-to-edge relationship, and hinge pin means extending generally along the longitudinal edges of adjacent planks and pivotally interconnecting the planks such that the planks are adapted to pivot upwardly and downwardly in an undulating fashion with respect to each other when the bridge is crossed.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
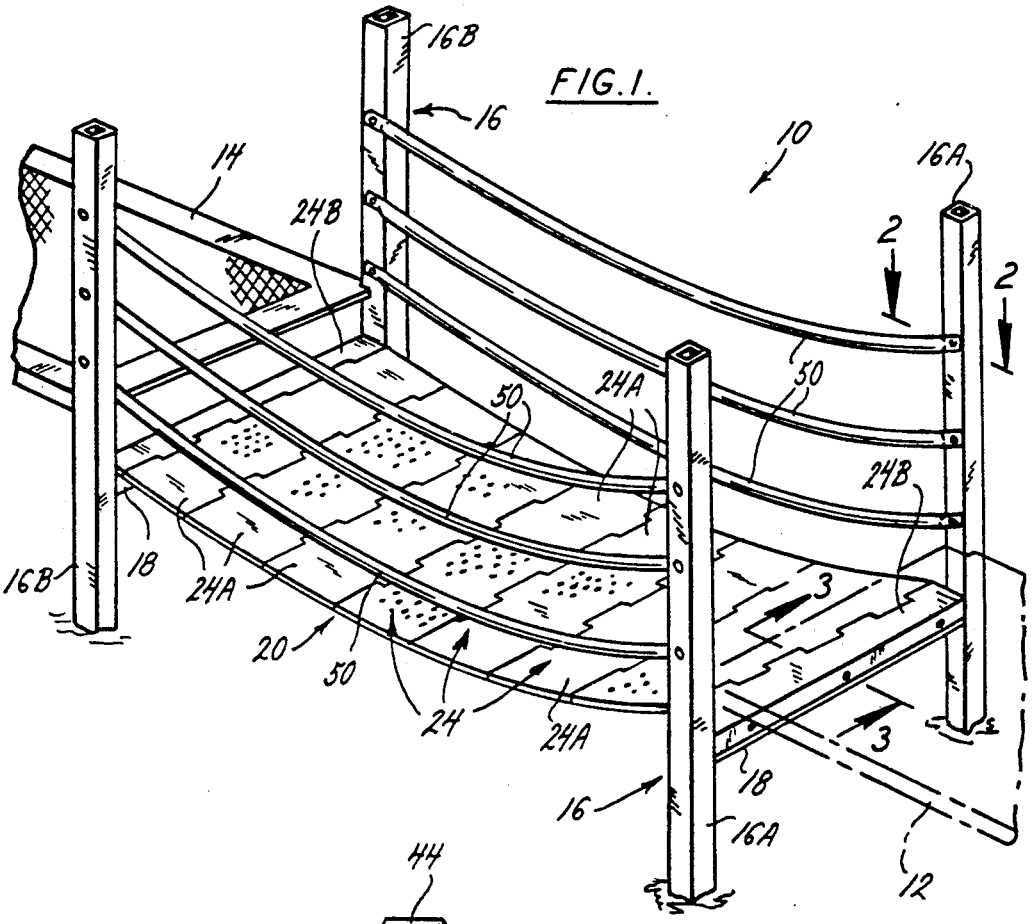
FIG. 1 is a perspective of an articulated bridge of the present invention and showing portions of other playground equipment with which the bridge may be incorporated.
Figure 2:
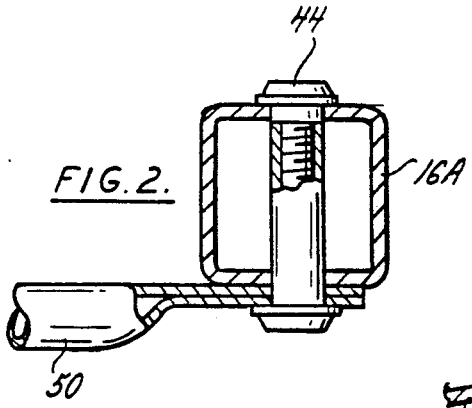
FIG. 2 is an enlarged fragmentary section taken in the plane including line 2—2 of FIG. 1.

Referring now to the drawings, and more particularly to FIG. 1, an articulated bridge of the present invention, indicated generally at 10, is shown incorporated as part of a larger playground structure including platforms 12 and 14 (the platform 12 being shown in phantom so that details of the articulated bridge 10 may be seen). The playground structure might also include slides, ladders, bars for climbing, and the like (not shown). It will be understood that the articulated bridge of this invention may also be used separate from any other playground equipment.

The articulated bridge 10 is shown to comprise a frame, indicated generally at 16, including two pairs of posts indicated at 16A and 16B, respectively The two posts of each pair of posts 16A, 16B are connected by a cross member 18 which defines a respective end of the bridge. A deck, generally indicated at 20, having opposite sides and opposite ends, is attached at its ends to a respective cross member 18 of the frame 16 such that the deck is suspended above the ground by the frame with the deck sagging downwardly between its opposing ends.

The deck 20 includes a plurality of generally rectangular planks, each generally designated 24, including center planks 24A and end planks 24B, having longitudinal edges 26 extending in side-to-side direction with respect to the deck with adjacent planks being in generally edge-to-edge relationship. Hinge pin means, comprising a plurality of cylindrical hinge pins 28, is provided for pivotally interconnecting adjacent planks 24 such that the planks are adapted to pivot upwardly and downwardly in an undulating fashion with respect to each other. Each hinge pin 28 extends generally along the longitudinal edges 26 of adjacent planks in the deck 20 substantially the entire length of the longitudinal edges, thus providing a strong hinge connection between adjacent planks 24.

Figure 6:
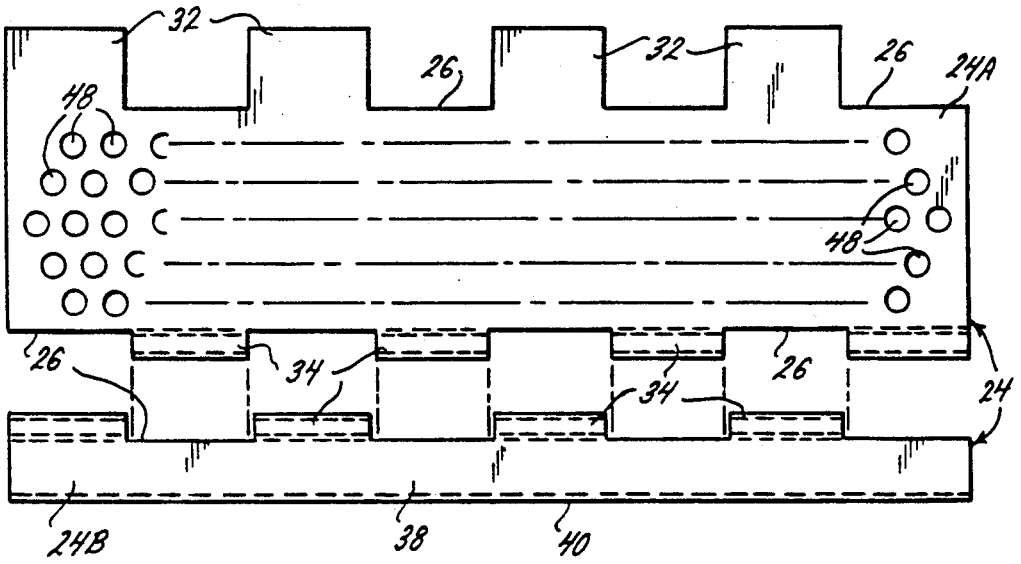
FIG. 6 is a plan view of an end plank and a center plank.
Figure 5:
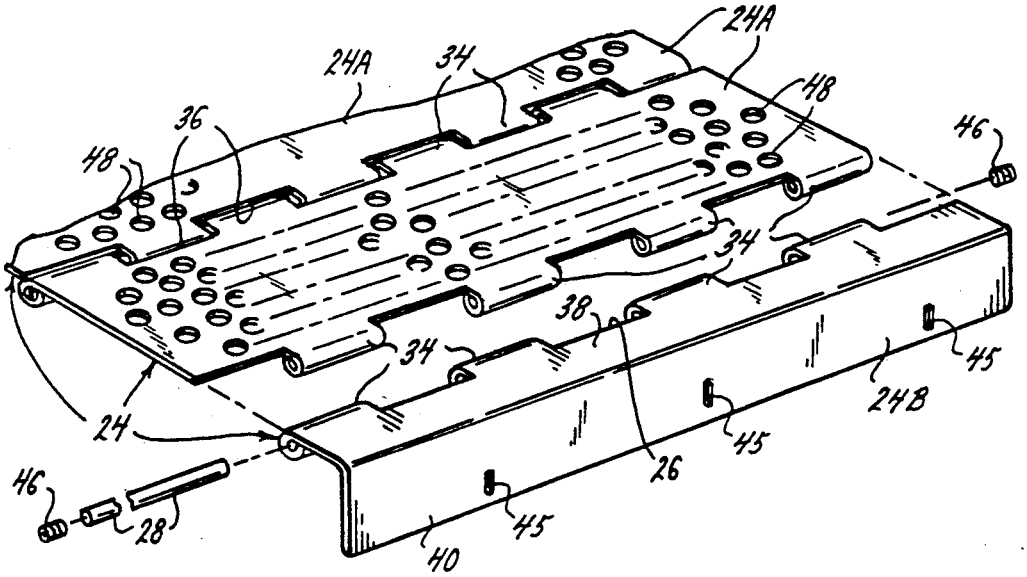
FIG. 5 is an exploded perspective of an end of the bridge deck illustrating interconnection of an end plank with an adjacent center plank.

The planks 24 are stamped from 11-gauge sheet metal blank, and initially have a plurality of rectangular tabs 32, as is illustrated at the upper longitudinal edge 26 of the center plank 24A in FIG. 6. These tabs 32 extend laterally outwardly from both longitudinal edges 26 of the center planks 24A, while the end planks 24B are formed with such tabs only along one longitudinal edge. The tabs 32 are rolled under to form integral sleeves 34 (broadly "sleeve means") extending along the longitudinal edges of the planks 24 at spaced intervals. It will be observed that the sleeves 34 along a first of the longitudinal edges 26 of the center plank 24A are offset longitudinally of the sleeves along a second of the longitudinal edges of the center plank. Thus, as may be seen in FIG. 5, when adjacent center planks 24A are brought together in edge-to-edge relationship to form the deck 20, the sleeves 34 along the first longitudinal edge of a first of the adjacent planks interdigitate with the sleeves along the second longitudinal edge of a second of the planks to form a single, substantially continuous sleeve.

Figure 3:
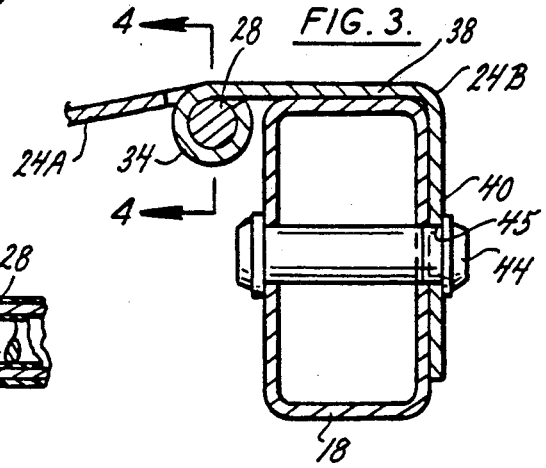
FIG. 3 is an enlarged fragmentary section taken in the plane including line 3—3 of FIG. 1.

The end planks 24B are L-shaped in cross section and include a generally horizontally extending deck portion 38 which is adapted for pivotal interconnection by one of the hinge pins 28 with an adjacent center plank 24A (FIG. 5), and a generally vertically extending flange portion 40 depending from a longitudinal edge of the deck portion 38. The deck portion 38 also has sleeves 34 spaced at intervals along its longitudinal edge 26 opposite the flange portion 40 so that they will interdigitate with the sleeves along the longitudinal edge of the adjacent center plank 24A. The end plank 24B is interconnected with the adjacent center plank 24A by one of the hinge pins 28 in the same way described above for adjacent center planks. As illustrated in FIG. 3, the flange portions 38 of the end planks 24B engage and extend downwardly over the outwardly facing sides of the cross members 18 and are attached to the cross members by suitable fasteners such as bolt and nut fasteners 44 received through openings 45 in the flange portions. Thus, the end planks 24B and fasteners 44 constitute means attaching the deck 20 to the frame 16 in this embodiment. The deck portion 38 extends inwardly from the flange portion 40, engaging the upwardly facing side of the cross member 18 such that the end plank 24B closely conforms to the contour of the outer surface of the cross member.

Figure 4:
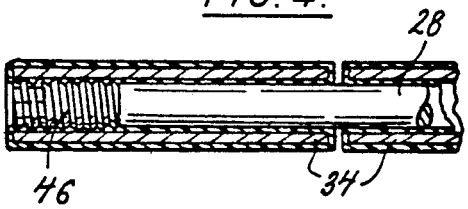
FIG. 4 is a section taken in the plane including line 4—4 of FIG. 3.

Once adjacent planks 24 are positioned with their sleeves 34 interdigitated to form a single, continuous sleeve extending along adjacent longitudinal edges 26 of the planks, the sleeves are adapted to receive one of the hinge pins 28 therein to pivotally interconnect the planks (FIG. 4). The hinge pins 28 are only slightly shorter than the length of the longitudinal edges 26 of the adjacent planks 24 and there is a close tolerance between the diameter of the hinge pins and the inner diameter of the sleeves 34. Plug means, comprising in this embodiment metal, socket headed bolts 46, are adapted to be secured in the laterally outer sleeves 34 of each pair of adjacent planks 24 for retaining the hinge pins 28 in the sleeves. The hinge connection of adjacent planks 24 extends substantially the full length of the longitudinal edges 26 of the planks and gives the deck 20 greater strength than designs which support the planks only at the sides of the deck, as by ropes or chains. Further, greater strength may be achieved while using lighter weight materials for the planks 24. Because the planks 24 are relatively small and lightweight and there are no bulky ropes or chains for connecting adjacent planks, the deck 20 of the present invention may be assembled at the factory and rolled into a relatively small, lightweight cylindrical roll for shipment to the customer. To assemble the bridge 10, the customer need only erect the frame 16, unroll the deck 20 and attach the flange portions 40 of the end planks 24B at opposite ends of the deck to the frame.

The planks 24, including their sleeves 34, and the frame 16 are coated with a vinyl coating V in order to increase their weather resistance. For purposes of clarity, only FIG. 4 illustrates the vinyl coating. Further in this regard, the center planks 24A are formed with a plurality of openings 48 in their upwardly facing surfaces which allow dirt and water on the deck 20 to pass through the deck to the ground. This prevents the accumulation of dirt and water on the deck 20 which helps to maintain the appearance of the bridge 10, reduces the possibility of corrosion because of standing water, and helps to keep the hinge connections relatively free of dirt for the desired articulation of adjacent planks. The sleeves 34 are coated with vinyl both inside and out, which, in addition to increasing the weather resistance of the plank, facilitates retention of the hinge pins 28 in their respective sleeves. As shown in FIG. 4, the threads of the metal bolts 46 used to retain the hinge pins 28 penetrate the vinyl as they are threaded into the laterally outer sleeves 34 of adjacent planks 24. Thus it will be observed that the hinge pins 28 are retained in their respective sleeves 34 by bolts 46 which are self-tapping. thereby avoiding the need to form the sleeves at the outer ends of the planks with internal threads.

The bridge 10 also includes handrails 50 located above the deck 20 along the sides of the deck and attached at opposite ends to frame posts 16A, 16B by suitable fasteners such as bolt and nut fasteners 44 such as are used to attach the end planks to the cross members 18 of the frame 16. More specifically, there are three handrails 50 at each side of the deck 20 vertically spaced from each other and generally parallel to each other. The provision of vertically spaced handrails 50 at different heights above the deck 20 allows children of different heights to grasp the handrail most easily and comfortably reached. The handrails 50 bow downwardly between their ends along a curve generally parallel to the sag of the deck 20. Therefore, at any position from end to end of the deck 20, each handrail 50 remains substantially the same distance above the deck. The vertical position of the handrail 50 relative to the body of a child will remain the same as the child crosses the bridge 10, making it easier for a child to maintain a grip on the handrail.

It will be observed that the pivotal interconnection of the planks 24 allowing the planks to pivot upwardly and downwardly with respect to each other provides for undulating motion of the bridge deck 20 as it is crossed. The interconnection of the planks 24 by hinge pins 28 received through interdigitated sleeves 34 of adjacent planks and extending substantially the entire length of the longitudinal edges 26 of the adjacent planks results in a sturdy construction, allowing the planks to be made of a relatively lightweight material (e.g., relatively thin gauge sheet metal). Further, the lightweight nature of the planks 24 and their pivotal interconnection with one another along their longitudinal edges 26 allows the deck 20 to be rolled up and shipped to a playground where the deck may simply be unrolled and mounted on the frame 16 to assemble the bridge 10. The vinyl coating of the planks 24 and frame 16 and the provision of openings 48 in the center planks 24A makes the bridge 10 resistant to the weather and to an accumulation of dirt and water on the deck 20.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An articulated playground bridge comprising, a frame, and a deck having opposite sides and opposite ends; and means attaching the deck at its opposite ends to the frame such that the deck is suspended above the ground by the frame with the unsupported deck sagging downwardly between its opposite ends, the deck comprising a plurality of generally rectangular planks having longitudinal edges extending in side-to-side direction with respect to the deck with adjacent planks being in generally edge-to-edge relationship, and hinge pin means extending generally along the longitudinal edges of adjacent planks and pivotally interconnecting the planks along their longitudinal edges such that the planks are adapted to pivot from a position generally coplanar with an adjacent plank upwardly and downwardly out of the plane of the adjacent plank in an undulating fashion with respect to each other when the bridge is crossed.

2. An articulated playground bridge as set forth in claim 1 wherein said hinge pin means comprises a plurality of cylindrical hinge pins, each hinge pin having substantially the same length as the planks.

3. An articulated playground bridge as set forth in claim 2 wherein said planks include sleeve means at their longitudinal edges for receiving said hinge pins for interconnecting adjacent planks.

4. An articulated playground bridge as set forth in claim 3 wherein said sleeve means comprises a plurality of sleeves integrally formed with the planks and extending along the longitudinal edges of the planks at spaced intervals, the sleeves along a first of the longitudinal edges of each plank being offset longitudinally of the plank from the sleeves along a second of the longitudinal edges of each plank such that the sleeves along the first longitudinal edge of a first of the planks are adapted to interdigitate with the sleeves along the second longitudinal edge of a second of the planks when the planks are placed adjacent each other in edge-to-edge relationship to form the deck.

5. An articulated playground bridge as set forth in claim 4 further comprising plug means adapted to be secured in the laterally outer sleeves of each pair of adjacent planks for retaining said hinge pins in the sleeves.

6. An articulated playground bridge comprising, a frame, and a deck having opposite sides and opposite ends; and means attaching the deck at its opposite ends to the frame such that the deck is suspended above the ground by the frame with the deck sagging downwardly between its opposite ends, the deck comprising a plurality of generally rectangular planks having longitudinal edges extending in side-to-side direction with respect to the deck with adjacent planks being in generally edge-to-edge relationship, and hinge pin means extending generally along the longitudinal edges of adjacent planks and pivotally interconnecting the planks such that the planks are adapted to pivot upwardly and downwardly in an undulating fashion with respect to each other when the bridge is crossed.

said hinge pin means comprising a plurality of cylindrical hinge pins, each hinge pin extending substantially the entire length of the longitudinal edges of adjacent planks, said planks including sleeve means at their longitudinal edges for receiving said hinge pins for interconnecting adjacent planks, said sleeve means comprising a plurality of sleeves integrally formed with the planks and extending along the longitudinal edges of the planks at spaced intervals, the sleeves along a first of the longitudinal edges of each plank being offset longitudinally of the plank from the sleeves along a second of the longitudinal edges of each plank such that the sleeves along the first longitudinal edge of a first of the planks are adapted to interdigitate with the sleeves along the second longitudinal edge of a second of the planks when the planks are placed adjacent each other in edge-to-edge relationship to form the deck, the planks and sleeves being coated with vinyl, plug means adapted to be secured in the laterally outer sleeves of each pair of adjacent planks for retaining said hinge pins in the sleeves, said plug means comprising a plurality of threaded bolts, the bolts having threads adapted to penetrate the vinyl coating of the planks as the bolts are threaded into said laterally outer sleeves for securing the bolts in the sleeves.

7. An articulated playground bridge as set forth in claim 1 further comprising rigid handrails disposed above the deck along the sides of the deck and mounted on the bridge solely by attachment of opposite ends of the handrails to the frame such that the handrails provide no support for the deck, the handrails bowing downwardly between their ends along a curve generally parallel to the sag of the deck.

8. An articulated playground bridge as set forth in claim 1 further comprising a plurality of rigid handrails on each side of the deck, the handrails on each side of the deck being generally parallel to and vertically spaced from each other, each handrail being mounted on the bridge solely by attachment of opposite ends of the handrails to the frame such that the handrails provide no support for the deck, the handrails bowing downwardly along a curve parallel to the sag of the deck.

9. An articulated playground bridge as set forth in claim 1 wherein the the planks include end planks adapted for attachment to the fame.

10. An articulated playground bridge comprising, a frame, and a deck having opposite sides and opposite ends; and means attaching the deck at its opposite ends to the frame such that the deck is suspended above the ground by the frame with the deck sagging downwardly between its opposite ends, the deck comprising a plurality of generally rectangular planks having longitudinal edges extending in side-to-side direction with respect to the deck with adjacent planks being in generally edge-to-edge relationship, and hinge pin means extending generally along the longitudinal edges of adjacent planks and pivotally interconnecting the planks such that the planks are adapted to pivot upwardly and downwardly in an undulating fashion with respect to each other when the bridge is crossed, the planks including end planks adapted for attachment to the frame, the end planks being L-shaped in cross section, including a generally horizontally extending deck portion and a generally vertically extending flange portion, said deck portion being adapted for pivotal interconnection by said hinge pin means with an adjacent plank, and said flange portion being adapted for attachment to the frame.

11. An articulated playground bridge as set forth in claim 1 wherein the planks are coated with vinyl for weather protection and have a plurality of openings therein adapted for passage of dirt and water therethrough to prevent accumulation of dirt and water on the deck.

* * * * *